US005253905A

United States Patent [19]

Hutson

[11] Patent Number: 5,253,905

[45] Date of Patent: Oct. 19, 1993

[54] DOOR LOCKING SYSTEM

[75] Inventor: Ozzie B. Hutson, Spartanburg, S.C.

[73] Assignee: Fortruss, Inc., Greenville, S.C.

[21] Appl. No.: 978,139

[22] Filed: Nov. 18, 1992

[51] Int. Cl.[5] ..... E05C 15/02

[52] U.S. Cl. ..... 292/92; 292/181; 292/259 R

[58] Field of Search ..... 292/21, 92, 259, 260, 292/93, 179, 181

[56] References Cited

U.S. PATENT DOCUMENTS

| | | | |
|---|---|---|---|
| 2,188,642 | 1/1940 | Keats | 292/181 |
| 2,475,478 | 7/1949 | Clair | 292/179 X |
| 2,475,478 | 7/1949 | Clair | 297/181 |
| 3,724,130 | 4/1973 | Bogue | 292/259 |
| 3,958,820 | 5/1976 | Teeple | 292/181 X |
| 4,179,143 | 12/1979 | Shy | 292/179 |
| 4,552,392 | 11/1985 | Morello | 292/181 |
| 4,631,528 | 12/1986 | Handel et al. | 340/545 |
| 4,762,350 | 8/1988 | Hurtado | 292/259 |
| 4,779,910 | 10/1988 | Dameron | 292/259 |
| 4,785,286 | 11/1988 | Martin | 340/545 |
| 4,796,445 | 1/1989 | Norden, Jr. | 70/94 |
| 4,852,921 | 8/1989 | Gilbert et al. | 292/259 |
| 4,856,831 | 8/1989 | Roden, Jr. | 292/259 |
| 4,961,330 | 10/1990 | Evans | 292/21 |
| 5,010,747 | 4/1991 | Norden, Jr. | 70/94 |

FOREIGN PATENT DOCUMENTS

| | | | |
|---|---|---|---|
| 846983 | 9/1960 | United Kingdom | 292/181 |
| 1330696 | 9/1973 | United Kingdom | 292/179 |

*Primary Examiner*—Richard E. Moore

*Attorney, Agent, or Firm*—Leatherwood Walker Todd & Mann

[57] ABSTRACT

A door locking system for attachment to an outwardly opening door which engages the door frame and which has a panic bar movable towards the door for disengaging the locking system. The locking device includes an outer sleeve fixedly mounted to the interior surface of the door and extending over one side of the door frame. An inner sleeve is provided within the outer sleeve which is pulled against a spring to a door frame engagement position, wherein inner sleeve extends over the other side of the door frame to prevent the door from being opened. A catch on the panic bar retains the inner sleeve in the engagement position, and movement of the panic bar towards the door causes the inner sleeve to retract into the outer sleeve, thereby allowing the door to be opened.

13 Claims, 5 Drawing Sheets

DOOR LOCKING SYSTEM

BACKGROUND OF THE INVENTION

This invention relates generally to a door locking system for securing a door and for allowing emergency egress.

Outwardly swinging exit doors are often found in commercial buildings. In addition to the use of outwardly opening doors by commercial establishments, residential dwellings, and in particular mobile homes, also often include outwardly opening doors. In a commercial environment, these doors are often located at the rear of the building and provide a service entrance to the establishment. Such doors are very commonly used in shopping centers as back doors to stores in the shopping center. Because these doors generally open toward a service driveway or parking area generally shielded from public view, the doors are often the target of burglars who simply chain or tie the exterior door handle to a truck or other vehicle and pull the door completely out of its door frame to obtain entry into the store. This type of burglary technique is becoming more and more common, particularly in high crime areas.

Outwardly opening doors have become popular in large part because of fire code requirements. During a fire or other emergency, an outwardly opening door affords a more efficient egress from a building than an inwardly opening door. Further, panic-type latch release mechanisms inherently operate better on an outwardly opening door than would be possible for an inwardly opening door.

Countervailing problems arise, however, when a door locking mechanism is to be provided which on one hand prevents the door from being torn from its frame by exterior pulling, and on the other hand affords a release of the door latching mechanism during an emergency situation which is in compliance with fire code standards.

Generally, fire code standards require that a door latch release mechanism be actuatable by someone pushing horizontally against the release mechanism. Panic latch releasing devices which require other than such a horizontal pushing force for actuation have often been banned by fire inspectors.

Several devices have been patented which include panic-type door latch release mechanisms. For example, U.S. Pat. No. 4,961,330, issued to Evans, discloses a door locking mechanism having a panic bar door lock release mechanism. U.S. Pat. No. 4,631,528, issued to Handel, et al., and U.S. Pat. No. 4,785,286, issued to Martin, each disclose panic bar door latch release mechanisms which also include alarms for signaling when the emergency door latch release mechanism has been actuated.

Other door locking devices have been patented which attempt to increase the security of a door by providing cross bar-type structures which prevent the inward opening of an inwardly opening door. U.S. Pat. No. 4,779,910, issued to Dameron, discloses a door locking device having receptacles attached to the door jamb for receipt of a lock bar assembly. U.S. Pat. No. 4,762,350, issued to Hurtado, illustrates an electrically operated locking device primarily for inwardly opening doors of a residential dwelling. While not illustrated, the patent suggests the possibility of attaching the electrically operated device to the exterior of a door.

For outwardly opening doors, devices have been patented which attempt to tie the door into the interior door frame. U.S. Pat. No. 4,796,445, issued to Norden, discloses a door locking mechanism having rotatable locking plates which may engage the door frame. U.S. Pat. No. 4,852,291, issued to Gilbert, et al., discloses a locking device attachable to a door knob which includes telescoping bars for contacting a door frame. U.S. Pat. No. 4,856,831, granted to Roden, discloses a door lock which includes a pair of restraining bars which contact the door facings adjacent the door. Finally, U.S. Pat. No. 5,010,747, issued to Norden, discloses a locking device having arms which are engagable with plates mounted in the door frame or with retainers mounted on the door frame.

Even in view of the above-patented devices, a need still exists for a high security door locking system for an outwardly opening door having an emergency release system which is acceptable under fire codes.

SUMMARY OF THE INVENTION

In view of the foregoing, it is an object of the present invention to provide a high security door locking system.

Another object of the present invention is to provide a door locking system with a panic release device which is operated by pushing it toward the door.

Another object of the present invention is to provide a door locking system which remains attached to a door when not in use.

Still another object of the present invention is to provide a door locking system of simple construction which does not require an electrical power source.

Yet another object of the present is to provide a door locking system which may be used in a variety of doors.

And, yet another object of the present invention to provide a door locking system having an alarm which is actuated when the panic release device is actuated.

Generally, these and other objects of the present invention are addressed by the present invention, one embodiment of which includes a door locking device for attachment to the surface of a door, the door being held within a door frame having first and second frame surfaces adjacent the door and spaced on opposite sides of the door from one another. The door is of conventional design, being latchable adjacent the first frame surface and being hinged adjacent the second frame surface for swinging outwardly away from the door frame.

The door locking device itself comprises a mounting structure for attachment to the surface of the door and retractable engagement mean fixedly connected to the mounting structure for selectively engaging at least one of the first and second door frame surfaces adjacent the door. The retractable engagement means includes an engagement member being movable from an engagement position adjacent the first frame surface, for restraining the door from outward movement from the door frame, to a retracted position for allowing the door to move outwardly from the door frame.

Retraction means actuatable in a substantially horizontal plane and mechanically contactable with the engagement member are provided for selectively causing the engagement member to be maintained in the engagement position. Upon a predetermined force being delivered to the retraction means in a direction substantially perpendicular to the surface of the door, the retraction means causes the engagement member to move from the engagement position to the retracted position, thereby allowing the door to swing outwardly from the door frame.

More specifically, one embodiment of the locking device includes the retraction means having a pushbar pivotally connected to the retractable engagement means for pivotal movement between a first position and a second position about a substantially horizontal plane. The pivotal movement of the pushbar from the first position to the second position causes the engagement member to move from the engagement position to the retracted position. The retractable engagement means may include an outer sleeve fixedly attached to the mounting structure, where the engagement member is an inner sleeve carried in the outer sleeve for telescopic movement with respect to the outer sleeve. A spring is carried within the inner sleeve the spring biasing the inner sleeve inwardly towards the interior of the outer sleeve, such that upon actuation of the retraction means, the spring forces the inner sleeve from the engagement position to the retracted position.

BRIEF DESCRIPTION OF THE DRAWINGS

The foregoing, as well as other objects of the present invention, will be more apparent from the following detailed description of the preferred embodiment of the invention, when taken together with the accompanying drawings, in which.

DESCRIPTION OF THE PREFERRED EMBODIMENT

Figure 1:
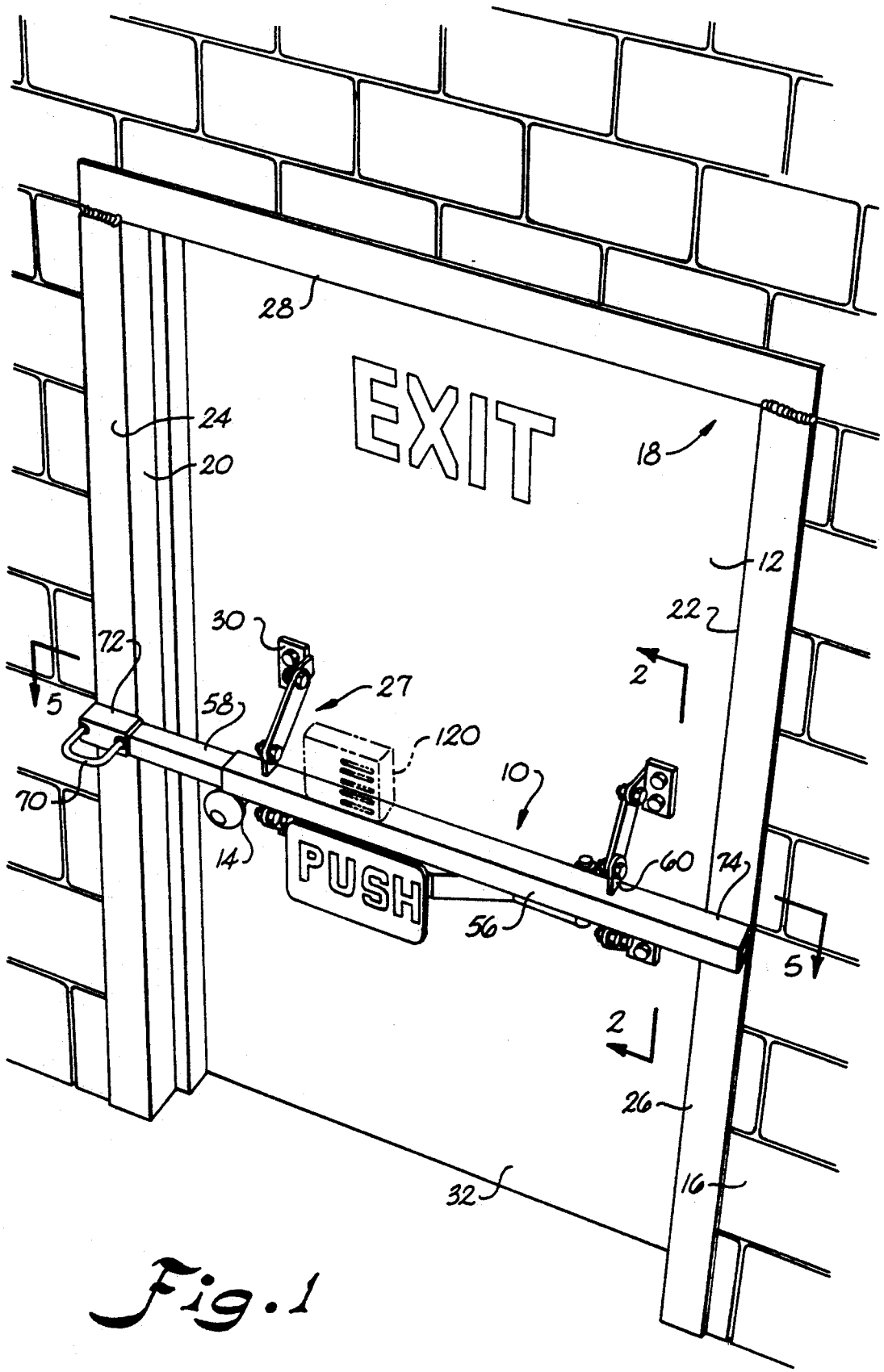
FIG. 1 is a perspective view of a door locking system constructed in accordance with the present invention attached to a door.

Referring to the drawings in detail, wherein like reference characters represent like elements throughout the various views, a door locking system constructed in accordance with the present invention is designated generally as 10 in FIG. 1.

FIG. 1 illustrates door locking system, generally 10, attached to a door 12 having a conventional door knob 14. Door 12 is mounted within wall 66 by means of a door frame, generally 18, which has first and second vertical frame members 20, 22, each having a respective frame surface 24, 26 which faces toward the interior of the building or room bounded by wall 16. Door frame 18 is of conventional construction, and is of the type which is generally constructed of steel. However, it is to be understood that door locking system 10 could also be used in connection with a door frame constructed of other materials, such as a metal other than steel, wood, plastic, fiberglass, etc. Door frame 16 includes an upper cross member 28 which is connected at the ends thereof to vertical door frame members 20, 22, respectively.

Door 12 is hinged by hinges (not shown) to door frame 18 such that door 12 swings outwardly from wall 16, and away from door frame surfaces 24, 26. Door 12 could be of conventional construction, and could be made of steel, wood, or some other suitable material, and also could be either of solid or hollow core construction.

Figure 2:
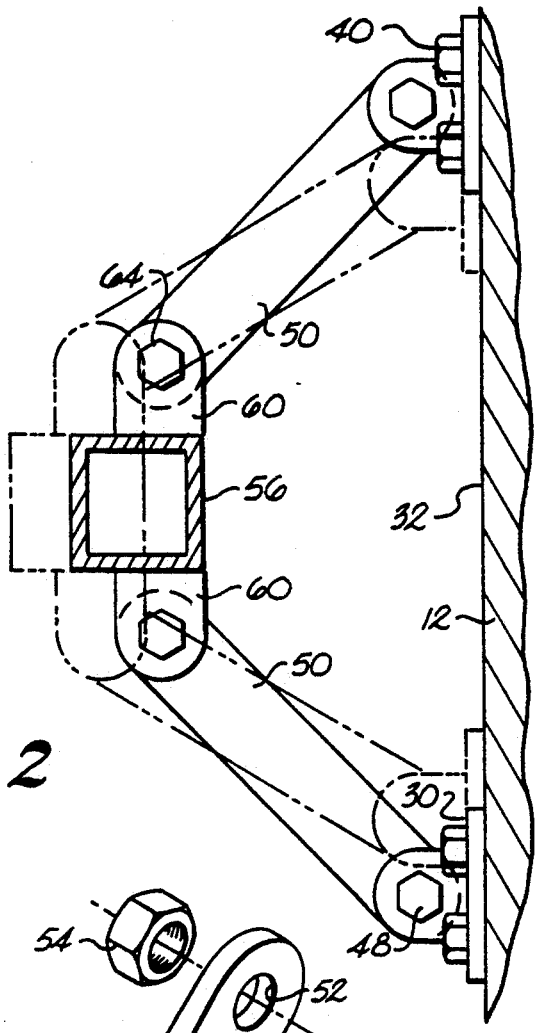
FIG. 2 is a sectional view taken along lines 2—2 of FIG. 1.
Figure 3:
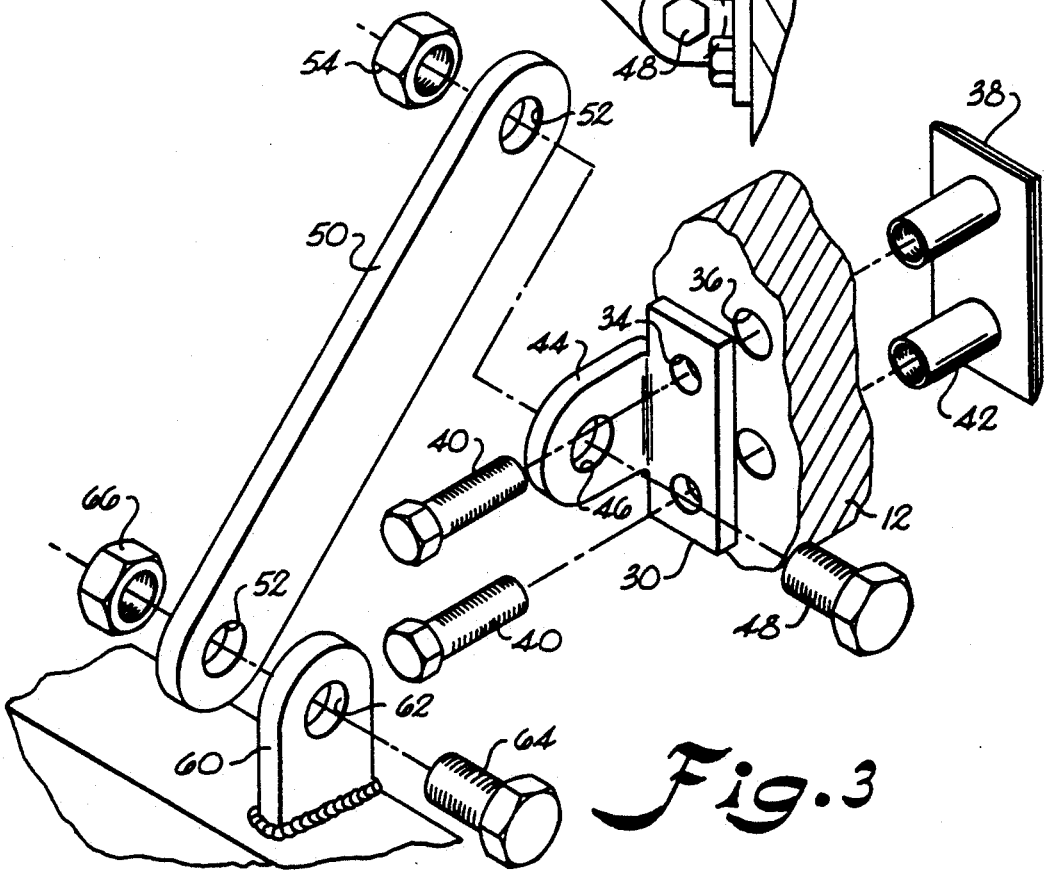
FIG. 3 is a partial perspective exploded view of the mounting structure for a door locking system constructed in accordance with the present invention.

Turning in more detail to the construction of door locking system 10, FIGS. 1 through 3 and 6 illustrate the mounting of locking system, or device, 10 to door 12. Mounting structures, generally 27, include mounting plates 30 which are provided for placement against interior surface 32 of door 12. Mounting plates 30 are provided with holes 34. Door holes 36 are provided through door 12 corresponding to holes 34 of mounting plates 30. A receiving member 38, as shown in FIG. 3, is provided for receiving bolts 40, which pass through holes 34 of mounting plates 30 and which are received in threaded bosses 42. Threaded bosses 42 are fixedly attached to receiving members 34 by welding, a press fit, or some other suitable attachment means.

Mounting plates 30 include ears 44, each having a bore 46 for receiving a bolt 48. Connected to each ear is a link 50, which has a bore 52 at each end thereof. One end of link 52 is connected to ear 44 through means of bolt 48 passing through bore 46 of ear 44 and bore 52 of link 50. Bolt 48 is retained in place by means of a nut 54. While only one mounting plate 30, receiving member 38, and link 50 structure has been described, there are four such combinations of structures associated with locking device 10, only one of such combination being described for convenience. It is also to be understood that other types of mounting structures could be used with locking device 10, such as unitary mounting brackets or removable brackets which would not include the bolted links 50.

Locking device 10 includes an outer sleeve 56, having a square or rectangular cross section which is preferably constructed of steel, although any other suitable material could be used. An engagement member, or inner sleeve, 58 is carried by outer sleeve 56 for sliding, or telescoping, movement with respect to outer sleeve 56. Inner sleeve 58 is of a cross-sectional design complimentary to that of outer sleeve 56, and in the drawings is shown, as well as outer sleeve 56, as having a square cross-sectional shape. Sleeves 56, 58 are illustrated having a square cross-sectional shape, but sleeves 56, 58 could be of any of a variety of cross-sectional shapes. Although not shown, sleeves 56, 58 could alternately be fashioned from cylindrical stock, such that both sleeves 56, 58 would have circular cross sections. This type of alternate embodiment is discussed below in more detail.

Connected to outer sleeve 56 are outwardly extending flanges 60 which are welded, bolted, or fixed to outer sleeve 56 by suitable means. Flanges 60 each include a bore 62 which is complimentary with a bore 52 of link 50 opposite the end of link 50 which is connected to ear 44 of mounting plate 30. A bolt 64 is provided for passing through bore 62 of flange 60 and bore 52 of link 50 to fix link 50 with respect to flange 60. Nut 66 is provided for maintaining bolt 64 in place. While only one flange 60 and link 50 connection has been described in detail, it is to be understood that there are 3 other such structural combinations provided with locking device 10 which fixedly attach outer sleeve 56 to door 12.

Figure 5:
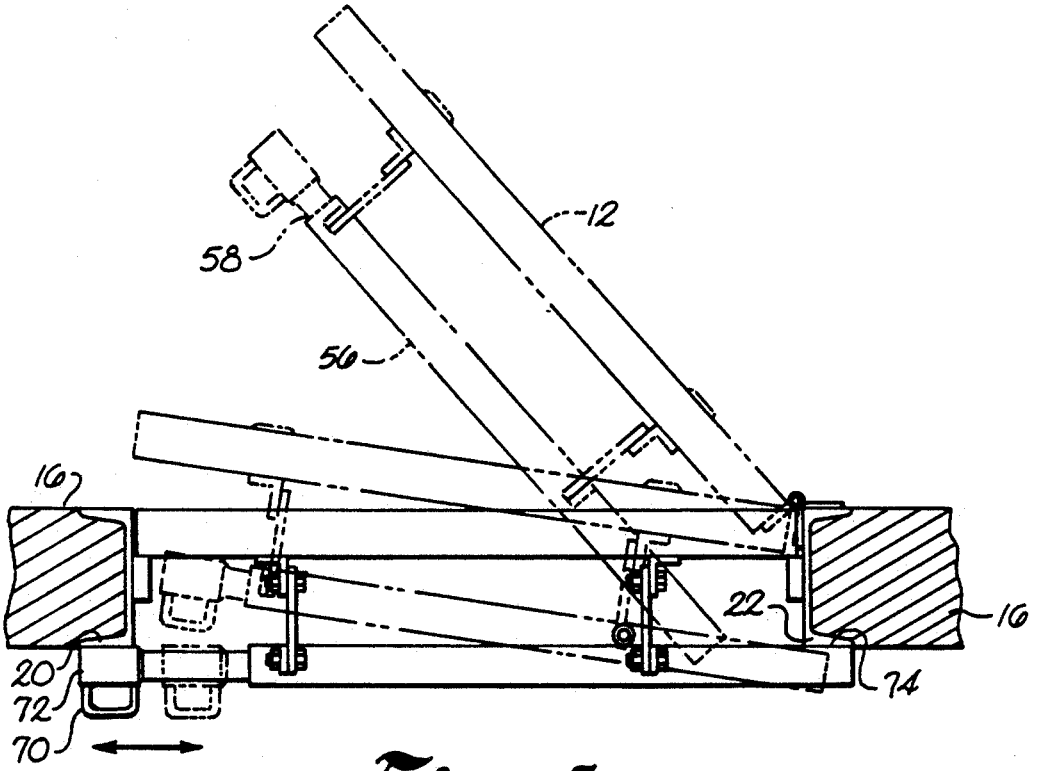
FIG. 5 is a sectional view taken along lines 5—5 of FIG. 1, with a door locking system constructed in accordance with the present invention shown in solid and phantom lines.
Figure 7:
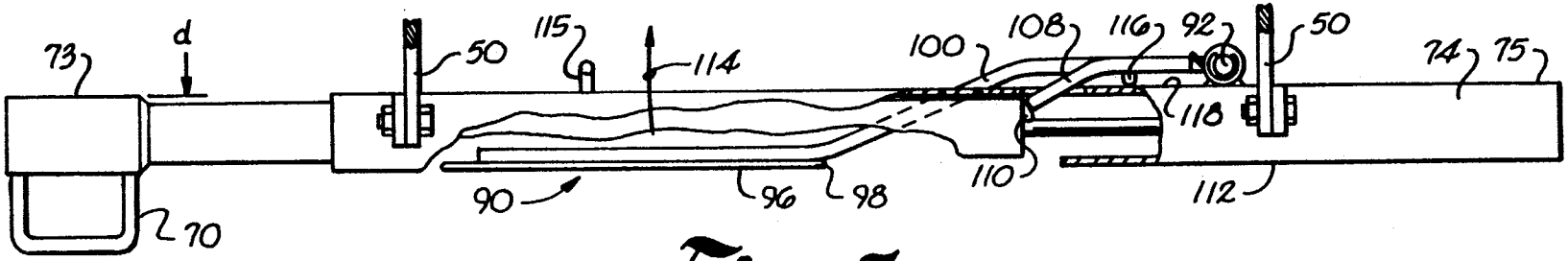
FIG. 7 is a sectional view taken along lines 7—7 of FIG. 6, with parts cut away.

FIGS. 1 and 5 illustrate locking device 10 in a door securing position, with inner sleeve 58 being in an extended engagement position immediately adjacent surface 24 of door frame member 20. Inner sleeve 58 is brought outwardly from outer sleeve 56, against the tension force of a coil spring 68, by means of a handle 70, which is fixedly attached to a door frame contact member 72. Door frame contact member 72 is illustrated as a section of a square sleeve segment having an interior area large enough for receiving the exterior surfaces of inner sleeve 58. Contact member 72 is attached to inner sleeve 58 to provide an added lateral dimension d, as illustrated in FIG. 7, such that engagement surface 73 is substantially coplanar with engagement surface 75 of outer sleeve 74. In other words, the distance between engagement surface 73 and frame surface 24 is substantially the same as the distance between engagement surface 75 of outer sleeve 56 and surface 26 of door frame 18.

Figure 6:
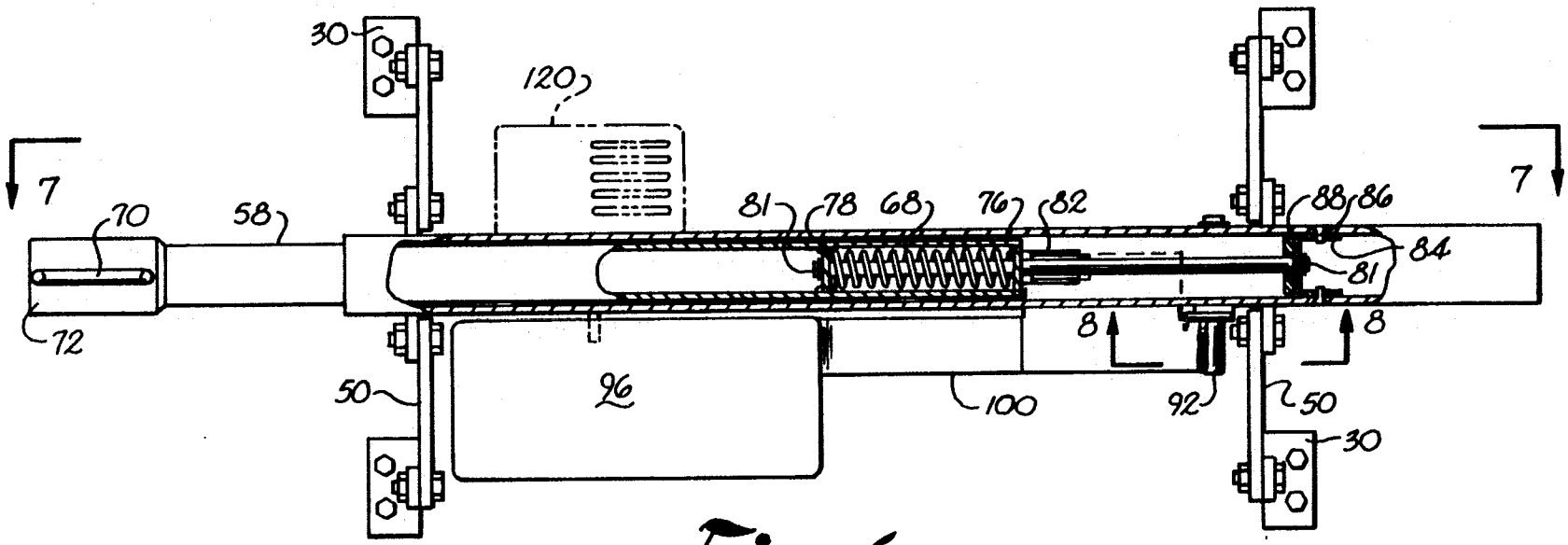
FIG. 6 is a front elevational view, with the parts cut away, of a door locking system constructed in accordance with the present invention.

As set forth above, inner sleeve 58 is pulled telescopically outward from outer sleeve 56 by means of handle 70, through working against spring 68. As illustrated in FIG. 6, spring 68 is captured between an end plate 76 of inner sleeve 58 and an engagement plate 78 connected to a plunger rod 80. While a coil spring 68 is described and illustrated, it is to be understood that the present invention is not limited to such a spring and that a variety of other types of springs, elastic members, or other biasing or retraction means could be used instead. For example, an elastic strap could be used instead of spring 68, or, an electrical, electro-mechanical, pneumatic or hydraulic system could also be used instead of spring 68 to retract inner sleeve 58.

Engagement plate 78 is retained on plunger rod 78 by means of a clip 81. Plunger rod 80 extends through a bore in end plate 76 and through a bushing 82 attached to end plate 76. The other end of plunger rod 80 is maintained within a retention member 84 held in place within outer sleeve 56 by screws 86. Plunger rod 80 passes through a bore in retention member 84 and is retained in bore by a clip 81. A rubber or elastic stop or bumper 88 is provided having a bore through which plunger rod 80 passes and which is contactable with bushing 76 or inner sleeve 58. Inner sleeve 58 is retained in its extended, door frame engagement position in a manner which will be described in more detail below.

Retraction means for retracting inner sleeve 58 includes a panic bar, or pushbar, 90 is provided which, for upon actuation, causes inner sleeve 58 to retract from its extended position, which prevents door 12 from being opened, to a retracted position further within outer sleeve 56, such that door 12 may be opened. Panic bar 90 pivots in a substantially horizontal plane about an upstanding pin 92 connected to panic bar 90. Pushbar 10 includes a panic contact surface 96 on a panel 98. Panel 98 is fixedly attached to angled lever arm 100 such that panel 98 is substantially parallel to door surface 32 and such that it extends substantially parallel to outer sleeve 56. Although lever arm 100 is shown being disposed from below outer sleeve 56, it could also be positioned above outer sleeve 56. Lever arm 100 is fixedly attached to pin 92, and is received in a journal 102 mounted to outer sleeve by bracket 94. A clip 104 retains pin 92, and accordingly lever arm 100, within journal 102. A torsion spring 106 cooperates with pin 92, and journal 102, to constantly urge lever arm 100 toward outer sleeve 56.

Figure 4:
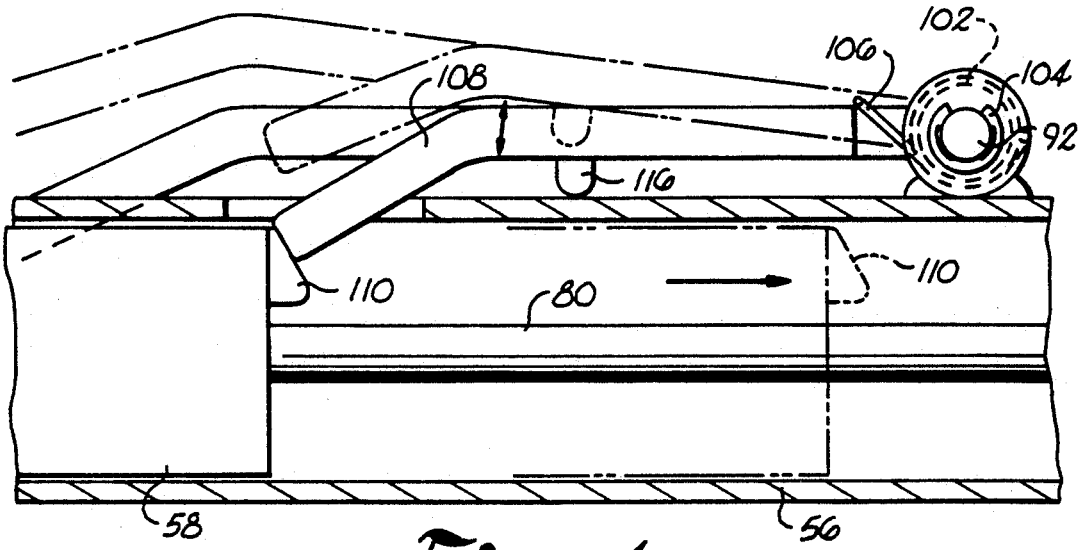
FIG. 4 is a sectional view illustrating movement of a pushbar and an inner sleeve constructed in accordance with the present invention.
Figure 8:
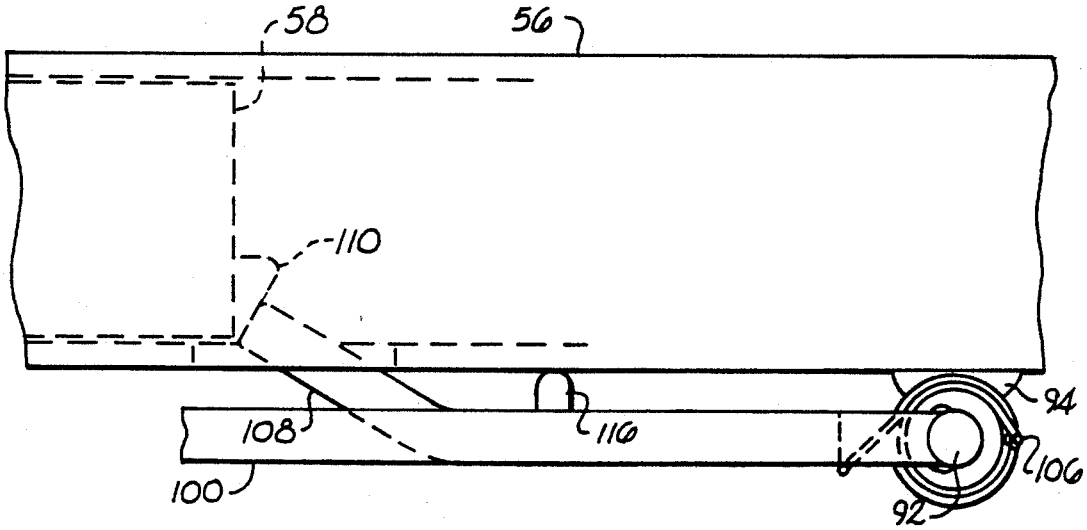
FIG. 8 is a sectional view taken along lines 8—8 of FIG. 6.

FIGS. 4, 7, and 8 illustrate the restraining member, or catch, 108 which cooperates with a ramped stop 110 carried on inner sleeve 58 and end cap 76. When inner sleeve 58 is in its extended, door frame engagement position, torsion spring 106 urges lever arm 100, and catch 108 carried thereon, to a position such that panel 98 is substantially parallel to the forward surface 112 of outer sleeve 56. In so doing, catch 108 moves into place adjacent to, and ultimately in contact with, ramped stop 110 of inner sleeve 58. This engagement between catch 108 and ramped stop 110 prevents retraction of inner sleeve 58 into outer sleeve 56, until panic contact surface 96 is depressed horizontally, in a direction as shown by arrow 114 in FIG. 7. A small projection 116, preferably constructed of resilient material such as rubber or plastic, is provided on lever arm 100 for contacting outer surface 118 of outer sleeve 56 to prevent over-extension of lever arm 100 in a direction away from door 12. An additional rigid stop 115 is provided on outer sleeve 56 for preventing over-extension of lever arm 100 in a direction towards door 12. When panel member 98 is moved horizontally toward door 12, catch 108 clears ramped stop 110, and inner sleeve 58 is immediately retracted into outer sleeve 56 by means of spring 68 acting on end plate 76 of inner sleeve 58. Such retraction of inner sleeve 58 into outer sleeve 56 causes contact member 72 of inner sleeve 58 to clear surface 24 of frame member 20, such that door 12 may be opened.

An alarm means, or box, generally 120, is preferably provided with locking device 10, and is preferably attached to outer sleeve 56. Alarm 120 is of conventional construction, and would be preferably battery-operated. Alarm 120 would be interconnected with pushbar 90 such than upon movement of pushbar 90 toward door 12, alarm 120 would be activated to produce an audible and/or visual alarm, signaling that inner sleeve 58 has been retracted into outer sleeve 56. Alarm box 120 could also include a simple warning light which would indicate when locking device was in an unsecured configuration, namely, when inner sleeve 58 is not in a door frame engaging position.

FIG. 2 illustrates how locking device 10 can be attached to a wide variety of doors. Ears 44, links 50, and flanges 60 cooperate together such that during mounting of locking device 10, outer sleeve 56 can be spaced from door 12 such that end 74 of outer sleeve 56 will be closely adjacent to surface 26 of door frame member 22, and contact surface 72 will be closely adjacent surface 24 of door frame member 20 (upon inner sleeve 58 being in an extended position), when door 12 is closed and latched to member 20. This adjustability feature allows for compensation between door surface 32 and the differing distances which may be presented by surfaces 24,26 among different doors.

To secure outwardly swinging door 12 from being opened or pulled out of door frame 18 from outside of the building or home, door 12 is first closed into frame 18. At this point, end 74 of outer sleeve 56 is closely adjacent surface 26 of door frame member 22 and extends in front of, or over, member 22. Then, handle 70 is grasped and pulled to extract inner sleeve 58 from outer sleeve 56. Handle 70 is pulled until catch 108 of lever arm 100 engages with ramped stop 110 of inner sleeve 58, which corresponds to contact member 72 being in a door frame engagement position adjacent surface 24 of door frame member 20. Engagement of stop 110 by catch 108 causes inner sleeve 58 to remain in the extended, door frame engagement position. With locking device 10 in this configuration, door 12 is securely held in door frame 18 against opening or removal from outside. Attempts to open door 12 from the outside would cause engagement surfaces 73,75 to engage door frame members 20,22, respectively, thereby causing pulling forces applied to the exterior of door 12 to be transmitted also to door frame 18.

In an example use, door lock device 10 could be used on the back door of a store and could be set at night by moving inner sleeve 58 to its extended position at night, prior to closing of the store. In the morning when the store is reopened, panic bar 90 could be moved forward to cause inner sleeve 58 to be retracted by spring 68 into outer sleeve 56 such that the door could be used throughout the day by simply using door knob 14. As shown in FIG. 5, it is not necessary for end 74 of outer sleeve 56 to retract in order for door 12 to be opened, because end 74 is configured to clear frame member 22 when door 12 is opened. Alarm 120 could be selectively temporarily overridden in such day-to-day store openings so as to not be a nuisance. Alternately, door locking device 10 could remain in use at all times on the door, except during emergency situations.

Preferably, door knob 14 is of the type having latching means which can be retained in a retracted position, such that simply pushing on door 12 itself, without turning knob 14, would cause the door to open. This is desired in an emergency situation because door 12 can be opened more quickly and more easily. Alternately, door knob 14 could be a dummy door knob, having no latching means whatsoever. Further, knob 14 could be eliminated altogether, with door 12 being opened and closed by grasping locking system 10.

In emergency situations, locking device 10 can be easily and quickly disengaged through pressing of panel 98 horizontally towards door 12 such that catch 108 of lever arm 100 disengages with stop 110 of inner sleeve 58, thereby causing inner sleeve to retract to within outer sleeve 56. This type of horizontal pressing motion for moving lever arm 100 to retract sleeve 58 is the type of motion fire inspectors typically require for emergency egress devices.

In an alternate embodiment not shown in the drawings, the locking device could be constructed of cylindrical inner and outer sleeves instead of the rectangular cross-sectional inner and outer sleeves shown. In such an alternate embodiment, a coil spring for biasing the inner sleeve inwardly into the outer sleeve could encircle the inner sleeve in the annular region between the outer diameter of the inner sleeve and the inner diameter of the outer sleeve. A ridge or other projection could be provided on a peripheral surface of the inner sleeve within the outer sleeve for engaging one end of the coil spring, and an end cap or other projection could be provided on the outer sleeve to contact the other end of the coil spring. Such an arrangement would bias the inner sleeve inwardly into the outer sleeve, but a catch would be provided as is with the preferred embodiment to retain the inner sleeve in an extended position. The remaining operation and structure of the alternate embodiment would be substantially the same as is the case with the preferred embodiment.

While the retraction means of locking device 10 has been illustrated and described as using a pivotal motion, in the operation of pushbar 90, it is to be understood that the pushbar could be configured to operate in a linear motion, instead of a pivotal motion. In such an embodiment (not shown), the pushbar would slide horizontally towards the door and would cause retraction of the inner sleeve in a manner similar to that which is disclosed herein.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art, without departing from the spirit or scope of the following claims.

What is claimed is:

1. A door locking device for attachment to the surface of a door, the door being held within a door frame having first and second outer frame surfaces adjacent the door and spaced on opposite sides of the door from one another, the door being hinged adjacent the second frame surface for swinging outwardly away from the door frame, the door locking device comprising:

a mounting structure for attachment to the surface of the door;

retractable engagement means fixedly connected to said mounting structure; said retractable engagement means including an engagement member movable from an engagement position adjacent to and in front of the first outer frame surface, for restraining the door from outward movement door frame, to a retracted position for allowing the door to move outwardly from the door frame; and retraction means actuatable in a substantially horizontal plane and mechanically contactable with said engagement member for selectively causing said engagement member to be maintained in said engagement position, such that upon a force being delivered to said retraction means in a direction substantially perpendicular to the surface of the door, said retraction means causes said engagement member to move from said engagement position to said retracted position, thereby allowing the door to swing outwardly from the door frame.

2. A door locking device as defined in claim 1, wherein said retraction means includes a pushbar pivotally associated with said retractable engagement means for pivotal movement between a first position and a second position about a substantially horizontal plane, said pivotal movement of said pushbar from said first position to said second position causing said retraction means to move said engagement member from said engagement position to said retracted position.

3. A door locking device as defined in claim 1, wherein said retractable engagement means includes an outer sleeve fixedly attached to said mounting structure and wherein said engagement member is an inner sleeve carried in said outer sleeve for telescopic movement with respect to said outer sleeve.

4. A door locking device as defined in claim 3, further comprising a spring carried within said inner sleeve; said spring biasing said inner sleeve inwardly towards within said outer sleeve, such that upon actuation of said retraction means, said spring forces said inner sleeve from said engagement position to said retracted position.

5. A door locking device as defined in claim 2, wherein said pushbar includes a restraining member for contacting said engagement member to retain said engagement member in said engagement position upon said pushbar being in said first position.

6. A door locking device as defined in claim 4, further comprising a plunger carried within both said inner sleeve and said outer sleeve, and a spring engagement surface carried within said inner sleeve; said spring contacting said plunger and said spring engagement surface for urging said inner sleeve towards within said outer sleeve.

7. A door locking device as defined in claim 3, further comprising a handle connected to said inner sleeve for allowing said inner sleeve to be retracted by hand from said retracted position within said outer sleeve to said engagement position.

8. A door locking device as defined in claim 1, further comprising alarm means associated with said retractable engagement means for signalling when said retraction means is actuated.

9. A door locking device as defined in claim 3, further comprising a fixed engagement member attached to said outer sleeve for positioning adjacent the second frame surface of the door frame.

10. A door locking device for attachment to the surface of a door, the door being held within a door frame having first and second frame surfaces adjacent the door and spaced on opposite sides of the door from one another, the door being hinged adjacent the second frame surface for swinging outwardly away from door frame, the door locking device comprising:

a mounting structure for attachment to the surface of the door;

an outer sleeve fixedly attached to said mounting structure, said outer sleeve extending adjacent to and in front of the second surface of the door frame;

an inner sleeve carried in said outer sleeve for telescopic movement within said outer sleeve; said inner sleeve being movable from an engagement position extended from said outer sleeve and adjacent the first frame surface, for restraining the door from outward movement the door from the door frame, to a retracted position within said outer sleeve, for allowing the door to move outwardly from the door frame;

biasing means associated with said inner sleeve for biasing said inner sleeve towards said outer sleeve; and a pushbar pivotally connected to said outer sleeve; said pushbar pivoting, upon a horizontally-directed force being applied thereto, between a first position and a second position; said pivotal movement of said pushbar from said first position to said second position causing said inner sleeve to retract from said engagement position to said retracted position, thereby allowing the door to swing outwardly from the door frame.

11. A door locking device as defined in claim 11, wherein said biasing means includes a spring carried within said inner sleeve; said spring being for biasing said inner sleeve inwardly towards within said outer sleeve, such that upon pivoting of said pushbar to said second position, said spring forces said inner sleeve from said engagement position to said retracted position.

12. A door locking device as defined in claim 11, wherein said pushbar includes a restraining member for contacting said inner sleeve to retain said inner sleeve in said engagement position upon said pushbar being in said first position.

13. A door locking device for attachment to the surface of a door, the door being held within a door frame having first and second frame surfaces adjacent the door and spaced on opposite sides of the door from one another, the door being latchable adjacent the first frame surface and being hinged adjacent the second frame surface for swinging outwardly away from the door frame, the door locking device comprising:

a mounting structure for attachment to the surface of the door;

an outer sleeve fixedly attached to said mounting structure, said outer sleeve extending adjacent to and in front of the second frame surface of the door frame;

an inner sleeve carried in said outer sleeve for telescopic movement within said outer sleeve; said inner sleeve being movable from an engagement position extended from said outer sleeve and adjacent the first frame surface, for restraining the door from outward movement from the door frame, to a retracted position within said outer sleeve, for allowing the door to move outwardly from the door frame;

a spring carried within said inner sleeve; said spring biasing said inner sleeve inwardly towards within said outer sleeve; and a pushbar pivotally connected to said outer sleeve; said pushbar including a restraining member for restraining said inner sleeve in said engagement position; said pushbar pivoting, upon a horizontally-directed force being applied thereto, between a first position and a second position; said pivotal movement of said pushbar from said first position to said second position causing said restraining member to cease restraining said inner sleeve in said engagement position and said inner sleeve to retract to said retracted position, thereby allowing the door to swing outwardly from the door frame.

* * * * *